US007204214B2

(12) United States Patent
Miyaji et al.

(10) Patent No.: US 7,204,214 B2
(45) Date of Patent: Apr. 17, 2007

(54) MULTI-CYLINDER INTERNAL COMBUSTION ENGINE

(75) Inventors: Yoshihiro Miyaji, Toyota (JP); Hirokazu Kurihara, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 66 days.

(21) Appl. No.: 11/236,632

(22) Filed: Sep. 28, 2005

(65) Prior Publication Data

US 2006/0070592 A1 Apr. 6, 2006

(30) Foreign Application Priority Data

Oct. 4, 2004 (JP) ..... 2004-291189

(51) Int. Cl.
*F01L 1/34* (2006.01)

(52) U.S. Cl. ..... 123/90.15; 123/90.17; 123/90.31; 123/90.6

(58) Field of Classification Search ..... 123/90.15
See application file for complete search history.

(56) References Cited

U.S. PATENT DOCUMENTS 5,522,352 A * 6/1996 Adachi et al. ..... 123/90.15
6,397,802 B1 * 6/2002 Rutschmann et al. .... 123/90.15
6,928,980 B2 * 8/2005 Yamakawa et al. ..... 123/311

FOREIGN PATENT DOCUMENTS

| | | |
|---|---|---|
| JP | 10-184404 | 7/1998 |
| JP | 2003-515025 | 4/2003 |
| WO | WO 01/36793 A1 | 5/2001 |

* cited by examiner

*Primary Examiner*—Thomas Denion
*Assistant Examiner*—Kyle M. Riddle
(74) *Attorney, Agent, or Firm*—Kenyon & Kenyon LLP

(57) ABSTRACT

#7 cylinder shares an exhaust manifold with #1 cylinder and is fired a predetermined firing interval after #1 cylinder. An exhaust cam shaft has a first cam for driving the exhaust cams of #1 cylinder and a second cam for driving the exhaust cams of #7 cylinder. A valve overlap period of #1 cylinder during its shift from an exhaust stroke to an intake stroke overlaps a time period during which the exhaust valves of the second cylinder are open in #7 cylinder while it is shifting from a power stroke to an exhaust stroke. The nose of the second cam is located farther in a retard direction than a position that is away in the retard direction from the nose of the first cam by an angle corresponding to the predetermined firing interval between the first and second cylinders.

6 Claims, 11 Drawing Sheets

MULTI-CYLINDER INTERNAL COMBUSTION ENGINE

INCORPORATION BY REFERENCE

The disclosure of Japanese Patent Application No. 2004-291189 filed on Oct. 4, 2004 including the specification, drawings and abstract is incorporated herein by reference in its entirety.

BACKGROUND OF THE INVENTION

1. Field of the Invention

The invention relates to a multi-cylinder internal combustion engine, and more particularly relates to a multi-cylinder internal combustion engine incorporating a cylinder arrangement in which a cylinder firing interval between two cylinders located in one bank of the internal combustion engine is 180° CA (Crank Angle).

2. Description of the Related Art

Published PCT application No. JP2003-515025 discloses a multi-cylinder internal combustion engine that is configured to realize an optimum and uniform air intake rate among all the cylinders formed in one bank of the engine. More specifically, this engine is a V-eight-cylinder engine whose cylinders are arranged such that a firing interval between two of the cylinders located in the same bank of the engine is 180° CA. With regard to these two cylinders, a pressure pulse that is produced in response to the exhaust valve of the later-fired cylinder being opened after fuel combustion therein can reach the first-fired cylinder which is at this time in a valve overlap region in which the intake and exhaust valves are both open. To counter this, the cams of the exhaust cam shaft are provided with different profiles.

In addition, Japanese Laid-opened Patent Application No. 10-184404 discloses an intake-exhaust control apparatus for an internal combustion engine which reduces pumping loss without reducing the fuel economy during a partial-load condition. This engine is equipped with variable valve drive mechanisms for the intake and exhaust valves, respectively, which change valve opening/closing timings and valve operation angles, and controls a valve overlap angle these mechanisms.

According to the foregoing internal combustion engine of Published PCT application No. JP2003-515025, however, producing the different profile cams requires setting a different production process for each cam, which reduces the production efficiency. Also, even if an automatic grinding machine is used to form the cams, its grinding program must be changed for each profile, which results in an increase in the production cost. Also, the use of such different profile cams creates the possibility that the cams be mounted at incorrect positions on a cam shaft during assembly of the cam shaft.

SUMMARY OF THE INVENTION

In view of the above, it is an object of the present invention to provide a multi-cylinder internal combustion engine which suppresses exhaust gas interference among the cylinders without reducing the production efficiency of a cam shaft.

To accomplish the above object, a first aspect of the invention relates to a multi-cylinder internal combustion engine, including a first cylinder; a second cylinder that shares an exhaust manifold with the first cylinder and is fired a predetermined firing interval after the first cylinder; and an exhaust cam shaft having a first cam for opening/closing an exhaust valve of the first cylinder and a second cam for opening/closing an exhaust valve of the second cylinder. In this engine, a valve overlap region of the first cylinder while the first cylinder is shifting from an exhaust stroke to an intake stroke overlaps a time period during which the exhaust valve of the second cylinder is open while the second cylinder is shifting from a power stroke to an exhaust stroke. Also, a nose of the first cam is located at a first phase position and a nose of the second cam is located at a second phase position on the exhaust cam shaft. The second phase position is farther in a retard direction than a position that is away in the retard direction from the first phase position by an angle corresponding to the predetermined firing interval between the first and second cylinders.

It is understood that "valve overlap region" represents a time period during which an intake valve and an exhaust valve are both open in each cylinder, and that "retard direction" represents the direction opposite to the rotating direction of a cam shaft, i.e., "advance direction".

According to the foregoing multi-cylinder internal combustion engine, since the position of the second cam is shifted in the retard direction, the timing of opening the exhaust valve of the second cylinder during its shift from a power stroke to an exhaust stroke is delayed with respect to the valve overlap region of the first cylinder. As a result, the pressure of exhaust gas from the second cylinder decreases, suppressing a pressure pulse that travels from the second cylinder to the first cylinder via the exhaust manifold and reducing the exhaust gas that reverses from the second cylinder to the first cylinder. As such, it is possible to diminish the influence of exhaust gas discharged from the second cylinder on the air intake of the first cylinder and thereby improve the volumetric efficiency of the first cylinder. Also, the foregoing construction of the multi-cylinder internal combustion engine can be made by simply shifting the position of the second cam without changing its profile, so the exhaust gas interference among the cylinders can be minimized without a decrease in the production efficiency of the exhaust cam shaft.

Also the foregoing multi-cylinder internal combustion engine may further include an intake cam shaft having a third cam for opening/closing an intake valve of the first cylinder and a fourth cam for opening/closing an intake valve of the second cylinder. The nose of the third cam is located at a third phase position and the nose of the fourth cam is located at a fourth phase position on the intake cam shaft. The third phase position is farther in a retard direction than a position that is away in an advance direction from the fourth phase position by an angle corresponding to the predetermined firing interval between the first and second cylinders.

In this case, since the position of the third cam is shifted in the retard direction, the timing of opening the intake valve of the first cylinder during its shift from an exhaust stroke to an intake stroke is delayed accordingly, reducing the valve overlap region of the first cylinder. According to this construction, therefore, the amount of exhaust gas reversing from the second cylinder to the first cylinder via the exhaust manifold decreases before air intake begins in the first cylinder. Therefore, it is possible to further improve the volumetric efficiency of the first cylinder.

Also, the third cam may have a profile that provides a delayed intake valve opening timing and a smaller intake valve operation angle as compared to an intake valve opening timing and an intake valve operation angle obtained with a profile of the fourth cam. In this case, the timing of opening the intake valve of the first cylinder can be delayed by changing the profile of the third cam. Note that this cam-profile based structure may be incorporated in addition to or instead of shifting the third cam in the retard direction.

Next, a second aspect of the invention relates to a multi-cylinder internal combustion engine, including a first cylinder; a second cylinder that shares an exhaust manifold with the first cylinder and is fired a predetermined firing interval after the first cylinder; and an intake cam shaft having a third cam for opening/closing an intake valve of the first cylinder and a fourth cam for opening/closing an intake valve of the second cylinder. A valve overlap region of the first cylinder while the first cylinder is shifting from an exhaust stroke to an intake stroke overlaps a time period during which an exhaust valve of the second cylinder is open while the second cylinder is shifting from a power stroke to an exhaust stroke. The nose of the third cam is located at a third phase position and the nose of the fourth cam is located at a fourth phase position on the intake cam shaft. The third phase position is farther in a retard direction than a position that is away in an advance direction from the fourth phase position by an angle corresponding to the predetermined firing interval between the first and second cylinders.

In this case, since the position of the third cam is shifted in the retard direction, the timing of opening the intake valve of the first cylinder during its shift from an exhaust stroke to an intake stroke is delayed accordingly, reducing the valve overlap region of the first cylinder. According to this construction, therefore, the amount of exhaust gas reversing from the second cylinder to the first cylinder via the exhaust manifold decreases before air intake begins in the first cylinder. Thus, it is possible to diminish the influence of exhaust gas discharged from the second cylinder on the air intake of the first cylinder and thereby improve the volumetric efficiency of the first cylinder. Also, the foregoing construction of the multi-cylinder internal combustion engine can be made by simply shifting the phase position of the third cam without changing its profile, so the exhaust gas interference among the cylinders can be minimized without a decrease in the production efficiency of the exhaust cam shaft.

In the multi-cylinder internal combustion engine according to the second aspect of the invention, too, the third cam may have a profile that provides a delayed intake valve opening timing and a smaller intake valve operation angle as compared to an intake valve opening timing and an intake valve operation angle obtained with a profile of the fourth cam. In this case, the timing of opening the intake valve of the first cylinder can be delayed by changing the profile of the third cam. Note that this cam-profile based structure may be incorporated in addition to or instead of shifting the third cam in the retard direction.

Accordingly, the multi-cylinder internal combustion engines according to the invention are able to suppress exhaust gas interference among the cylinders without reducing the production efficiency of a cam shaft.

BRIEF DESCRIPTION OF THE DRAWINGS

The foregoing and/or further objects, features and advantages of the invention will become more apparent from the following description of preferred embodiment with reference to the accompanying drawings, in which like numerals are used to represent like elements and wherein.

DETAILED DESCRIPTION OF THE PREFERRED EMBODIMENTS

Hereinafter, exemplary embodiments of the invention will be described with reference to the accompanying drawings. In each drawing, like numerals will be used for like elements and components.

(First Exemplary Embodiment)

Figure 1:
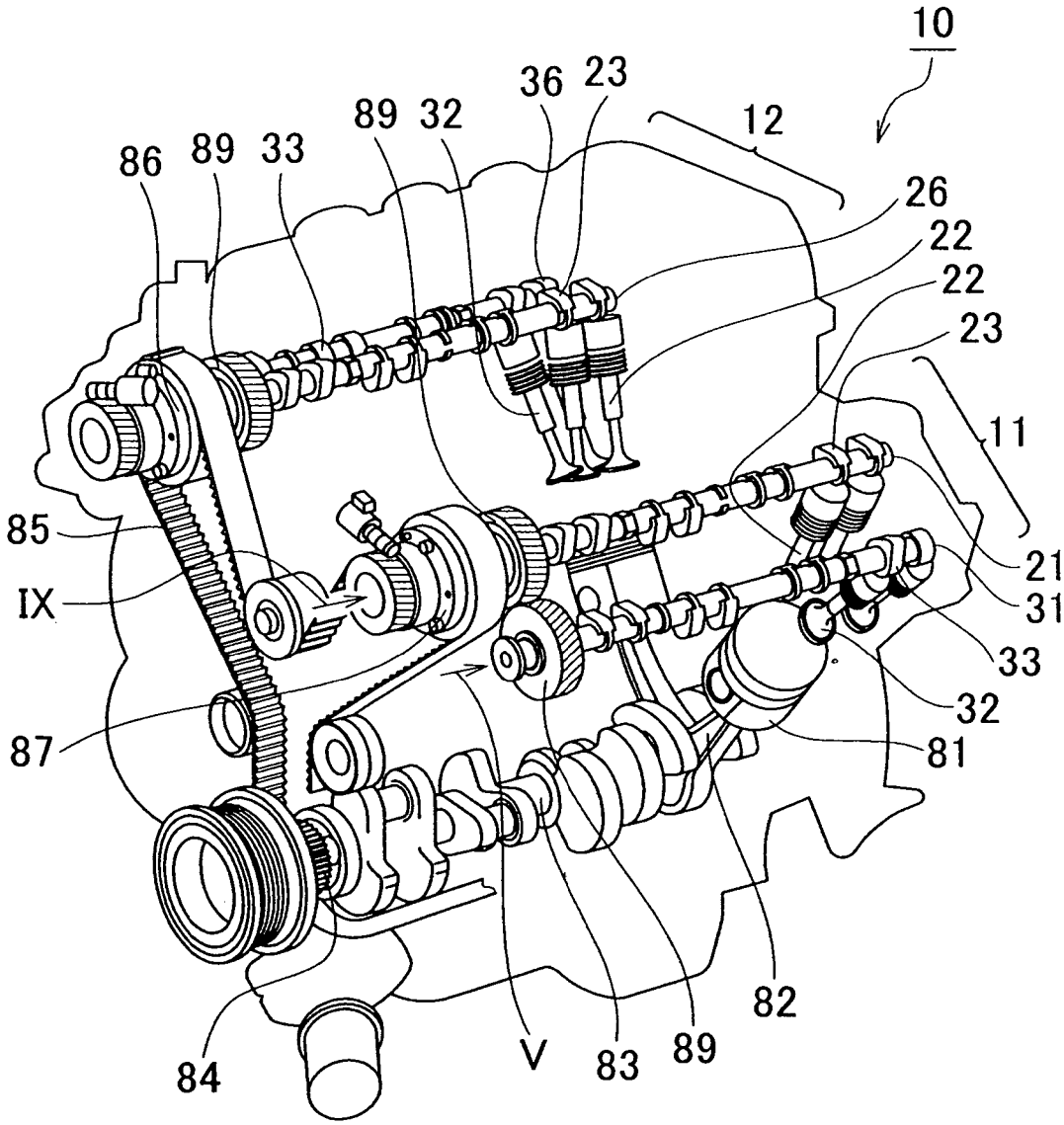
FIG. 1 shows a perspective view of an internal combustion engine according to the first, second, and third exemplary embodiments of the invention.

FIG. 1 shows a perspective view of an internal combustion engine 10 according to a first exemplary embodiment of the invention (will be simply referred to as "engine 10"). The engine 10 is a V-eight-cylinder internal combustion engine having a left bank 11 and a right bank 12 arranged in a V shape.

In each of the left and right banks 11,12 are provided four cylinders each containing a piston 81 that reciprocates therein during engine operation. Each piston 81 is connected to a crank shaft 82 as an output shaft of the engine 10 via a corresponding connecting rod 82. A crank shaft sprocket 84 is provided at one end of the crank shaft 83.

An intake cam shaft 21 and an exhaust cam shaft 31 are provided in the left bank 11 and an intake cam shaft 26 and an exhaust cam shaft 36 in the right bank 12. Cams 23 each having a uniform profile are formed on each intake cam shaft 21, 26 along their axial direction. As the intake cam shafts 21, 26 rotate, the cams 23 drive the intake valves 22 of the respective cylinders. Similarly, cams 33 each having a uniform profile are formed on each exhaust cam shaft 31, 36 along their axial direction, and as the exhaust cam shafts 31, 36 rotate, the cams 33 drive the exhaust valves 32 of the respective cylinders.

A scissors gear 89 is provided at an end of each of the cam shafts 21, 26, 31, and 36, and the scissors gears 89 of the intake and exhaust cam shafts in each bank are meshed. A cam shaft timing pulley 87 is provided at an end of the intake cam shaft 21 and a cam shaft timing pulley 86 at an end of the intake cam shaft 23. A timing belt 85 is wound around the crank shaft sprocket 84, and the cam shaft timing pulleys 86, 87. In operation, reciprocation of the pistons 81 rotates the crank shaft 83, and the rotation of the crank shaft 83 is transmitted to the intake cam shafts 21, 26 via the timing belt 85, and to the exhaust cam shafts 31, 36 via the respective scissors gears 89.

Figure 2:
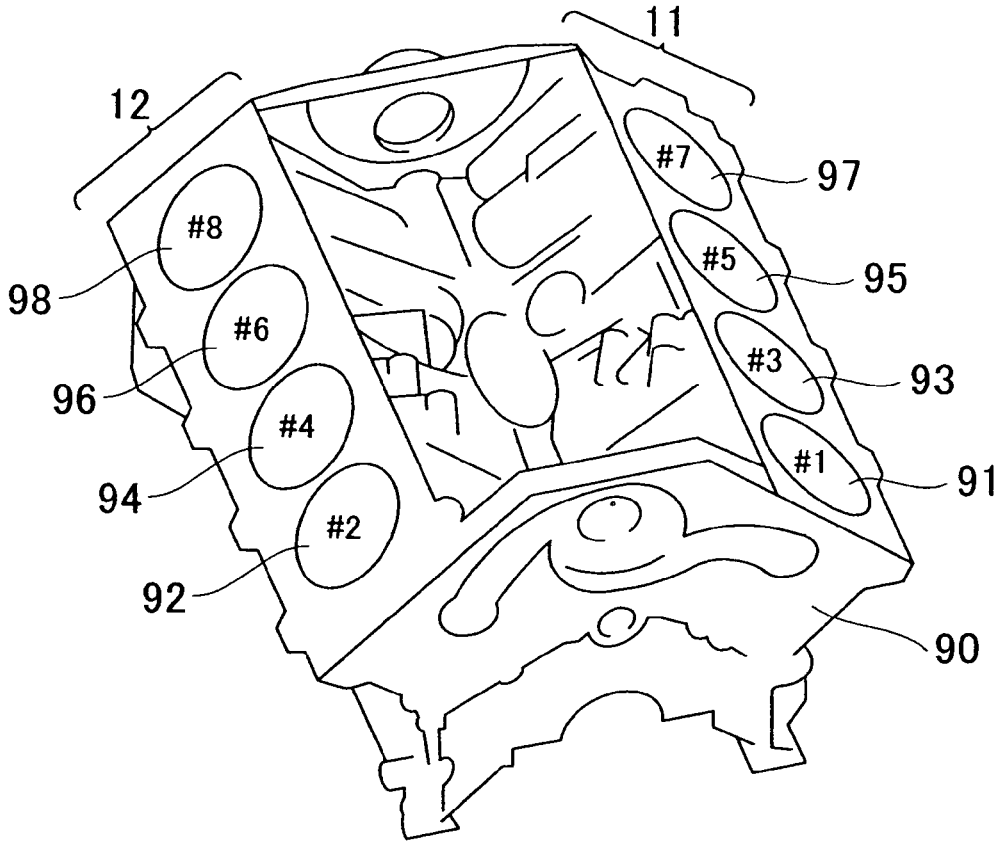
FIG. 2 shows a perspective view of a cylinder block of the engine shown in FIG. 1.

FIG. 2 shows a perspective view of the cylinder block of the engine 10. In the cylinder block are formed cylinders 91, 93, 95, and 97 which are lined up in this order in the left bank 11 from the front side to the rear side of the vehicle and correspond to cylinder numbers #1, #3, #5, and #7, respectively, and cylinders 92, 94, 96, and 98 which are lined up in this order in the right bank 12 from the front side to the rear side of the vehicle and correspond to cylinder numbers #2, #4, #6, and #8, respectively.

The intake valves 22 and the exhaust valves 32 for the #1 cylinder #91, the #3 cylinder 93, the #5 cylinder 95, and the #7 cylinder 97 are driven by the intake cam shaft 21 and the exhaust cam shaft 31, respectively, and the intake valves 22 and the exhaust valves 32 for the #2 cylinder #92, the #4 cylinder 94, the #6 cylinder 6, and the #8 cylinder 98 by the intake cam shaft 26 and the exhaust cam shaft 36, respectively.

Figure 3:
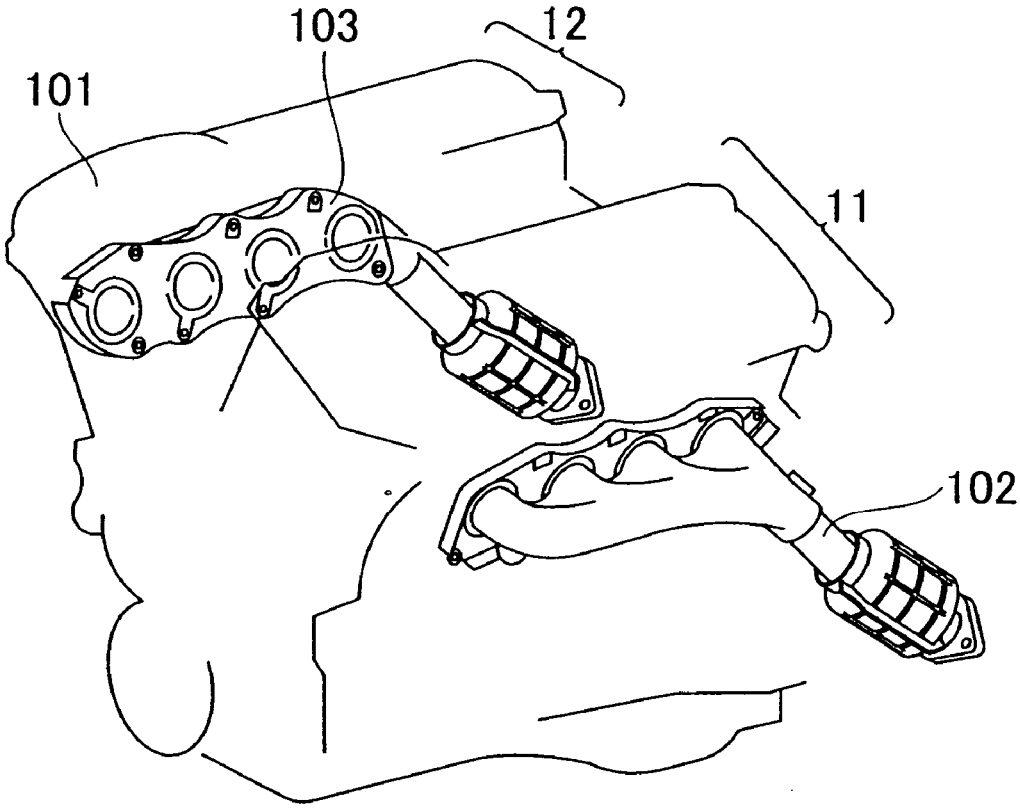
FIG. 3 shows a perspective view of exhaust manifolds attached to the engine shown in FIG. 1.

FIG. 3 shows a perspective view of exhaust manifolds 102, 103 of the engine 10. The exhaust manifold 102 is provided at the left bank 11 and the exhaust manifold 103 at the right bank 12. As such, the #1 cylinder #91, the #3 cylinder 93, the #5 cylinder 95, and the #7 cylinder 97 in the left bank 11 share the exhaust manifold 102 so that exhaust gas from the exhaust ports of these cylinders is discharged to the outside of the vehicle through the exhaust manifold 102. Likewise, the #2 cylinder #92, the #4 cylinder 94, the #6 cylinder 6, and the #8 cylinder 98 in the right bank 12 share the exhaust manifold 103 so that exhaust gas from the exhaust ports of these cylinders is discharged to the outside of the vehicle through the exhaust manifold 103.

Figure 4:
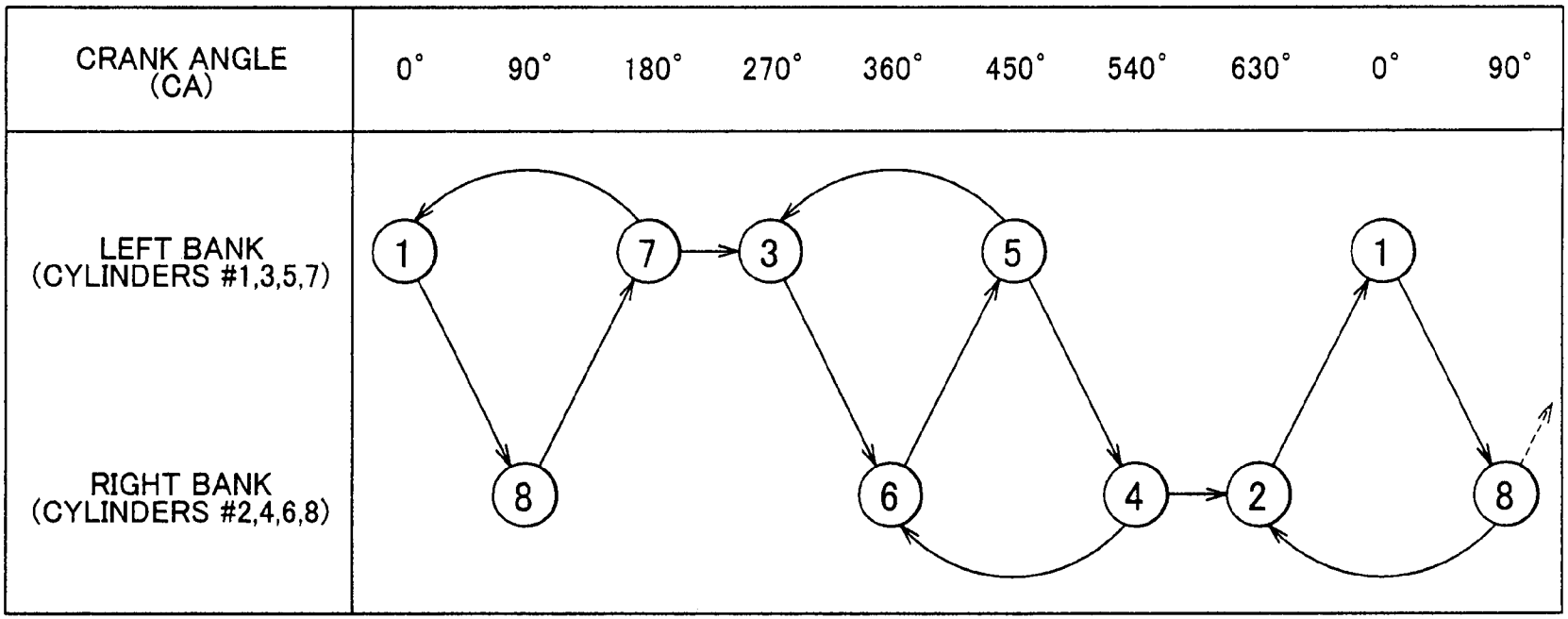
FIG. 4 shows a chart illustrating the cylinder firing order for the engine shown in FIG. 1.

FIG. 4 is a chart indicating the cylinder firing order of the engine 10. Referring to the chart, the cylinders are fired in the order of #1-#8-#7-#3-#6-#5-#4-#2 and the firing interval between two cylinders that are consecutive in the cylinder firing order is 90° C.A.

The engine 10 goes through one operation cycle consisting of an intake stroke, a compression stroke, a power stroke, and an exhaust stroke (4 strokes), every time the crank shaft 83 turns twice, i.e., per 720° C.A. So, there is a delay of one stroke between every two cylinders one of which being two behind the other in the cylinder firing order, i.e., by 180° C.A. For example, with regard to the #1 cylinder 91 and the #7 cylinder 97 which is fired 180° C.A behind the #1 cylinder 91, when the #1 cylinder 91 is shifting from an exhaust stroke to an intake stroke, the #7 cylinder 97 is shifting from a power stroke to an exhaust stroke. As such, the #7 cylinder 97 proceeds one stroke behind the #1 cylinder 91. At this time, the #1 cylinder 91 is in a valve overlap region in which the exhaust valves 32 and the intake valves 22 are open while the #7 cylinder 97 is in a blow-down state in which the exhaust valves 32 are open and the intake valves 22 are closed.

This relationship also applies to each combination of the #3 cylinder 93 and the #5 cylinder 95 in the left bank 11, the #6 cylinder 96 and the #4 cylinder 94, and the #2 cylinder 92 and the #8 cylinder 98 in the right bank 12. That is, the #5 cylinder 95 is fired 180° C.A behind the #3 cylinder 93, and thus the #4 cylinder 94 behind the #6 cylinder 96, and the #8 cylinder 98 behind the #2 cylinder 92.

Figure 5:
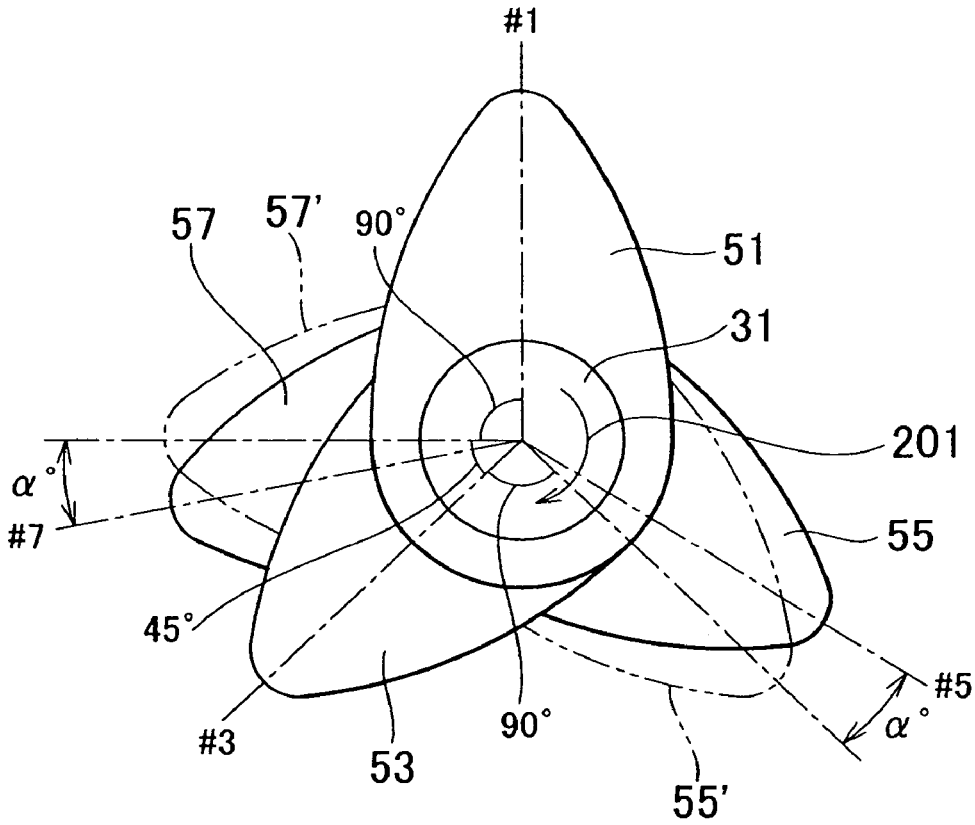
FIG. 5 shows a front view of an exhaust cam shaft as seen along arrow V in FIG. 1.

FIG. 5 shows a front view of the exhaust cam shaft 31 as seen along arrow V in FIG. 1. Note that the scissors gear 89 is not shown in FIG. 5. As shown in FIG. 5, cams are formed on the exhaust cam shaft 31 along its axial direction, which are a cam 51 for driving the exhaust valves 32 of the #1 cylinder 91, a cam 53 for driving the exhaust valves 32 of the #3 cylinder 93, a cam 55 for driving the exhaust valves 32 of the #5 cylinder 95, and a cam 57 for driving the exhaust valves 32 of the #7 cylinder 97. Each of the cams 51, 53, 55, 57 has a cross sectional shape which extends in one side along the radial direction of the exhaust cam shaft 31, and the extended portion of each cam is called "nose". As the exhaust cam shaft 31 rotates, the nose of each cam depresses a valve lifter provided at a corresponding exhaust valve 32 and thereby opens it. The cams 51, 53, 55, and 57 have the same profile.

The exhaust cam shaft 31 rotates clockwise i.e., in the direction pointed by allow 201 in FIG. 5 and turns once every time the crank shaft 83 turns twice, i.e., per 720° C.A. The cylinder firing interval between the #1 cylinder 91 and the #3 cylinder 93 is 270° C.A, therefore the nose of the cam 53 is located at a phase position that is 135° (=270° C.A/2) away from the nose of the cam 51 in a retard direction (i.e., the direction reverse to the rotating direction of the exhaust cam shaft 31 indicated by allow 201).

Meanwhile, the nose of the cam 57 for driving the exhaust valves 32 of the #7 cylinder 97 which is fired 180° C.A behind the #1 cylinder 91 is located 90°+$\alpha$° away from the nose of the cam 51 in the retard direction. That is, the phase position of the cam 57 is further shifted in the retard direction by $\alpha$° from the position that is 90° away in the retard direction from the nose of the cam 51 (the position denoted by 57' in FIG. 5). Similarly, the nose of the cam 55 for driving the exhaust valves 32 of the #5 cylinder 95 which is fired 180° C.A behind the #3 cylinder 93 is located 90°+$\alpha$° away from the nose of the cam 53 in the retard direction. That is, the phase position of the cam 55 is further shifted in the retard direction by $\alpha$° from the position that is 90° away in the retard direction from the nose of the cam 53 (the position denoted by 55' in FIG. 5). For example, $\alpha$° is set to 10°, however it may be set to other angle based on the profile of each cam, the required engine performance/characteristic, and the like.

The exhaust cam shaft 36 has substantially the same structure as that of the exhaust cam shaft 31 described above. That is, the cam for driving the exhaust valves 32 of the #8 cylinder 98 is formed such that its nose is located at a phase position that is 90°+$\alpha$° away from the nose of the cam for driving the exhaust valves 32 of the #2 cylinder 92 in the retard direction, and the cam for driving the exhaust valves 32 of the #4 cylinder 94 is formed such that its nose is located at a phase position that is 90°+$\alpha$° away from the nose of the cam for driving the exhaust valves 32 of the #6 cylinder 96 in the retard direction.

Figure 6:
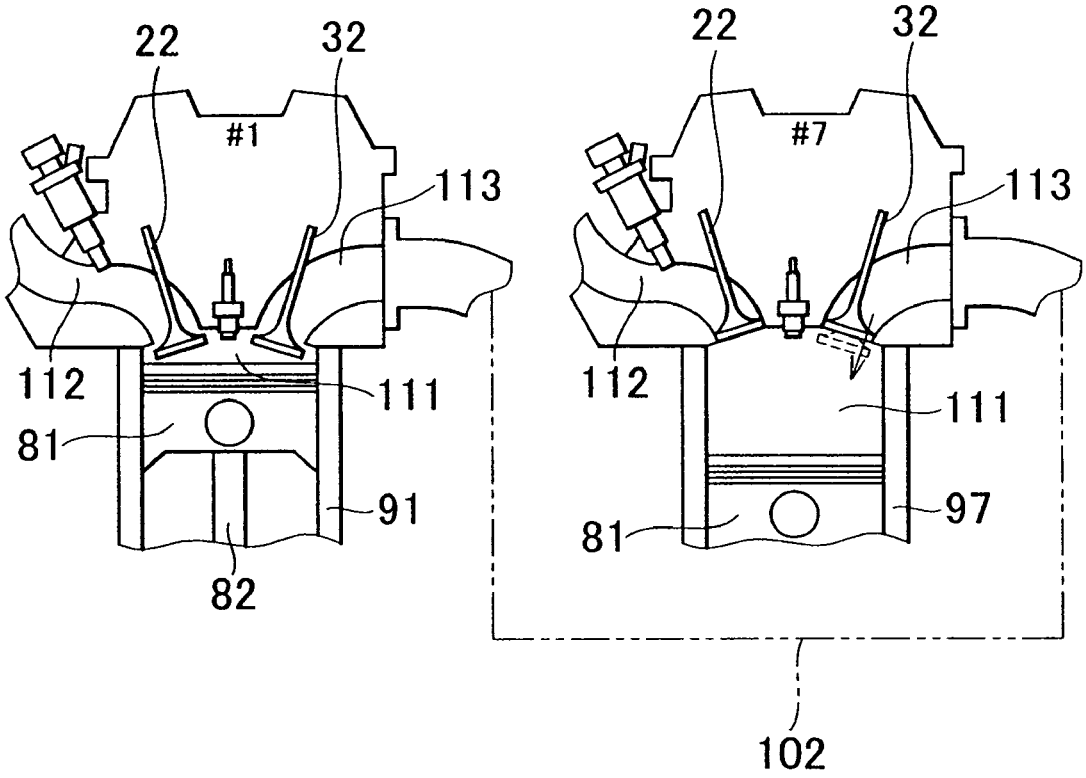
FIG. 6 shows cross sectional views of the #1 cylinder 91 and the #7 cylinder 97.

FIG. 6 shows cross sectional views of the #1 cylinder 91 and the #7 cylinder 97, respectively. Illustrated in these views are a state in which the #1 cylinder 91 is shifting from an exhaust stroke to an intake stroke while the #7 cylinder 97 is, on the other hand, shifting from a power stroke to an exhaust stroke. As described above, the nose of the cam 57 is further shifted in the retard direction by $\alpha$° from the position that is away in the retard direction from the nose of the cam 51 by an angle corresponding to the cylinder firing interval between the #1 cylinder 91 and the #7 cylinder 97 (=180° C.A=90°). Therefore, the timing at which the exhaust valves starts opening 32 in the #7 cylinder 97 during its shift from a power stroke to an exhaust stroke is delayed with respect to the valve overlap region of the #1 cylinder 91 where the intake and exhaust valves are both open.

Figure 7:
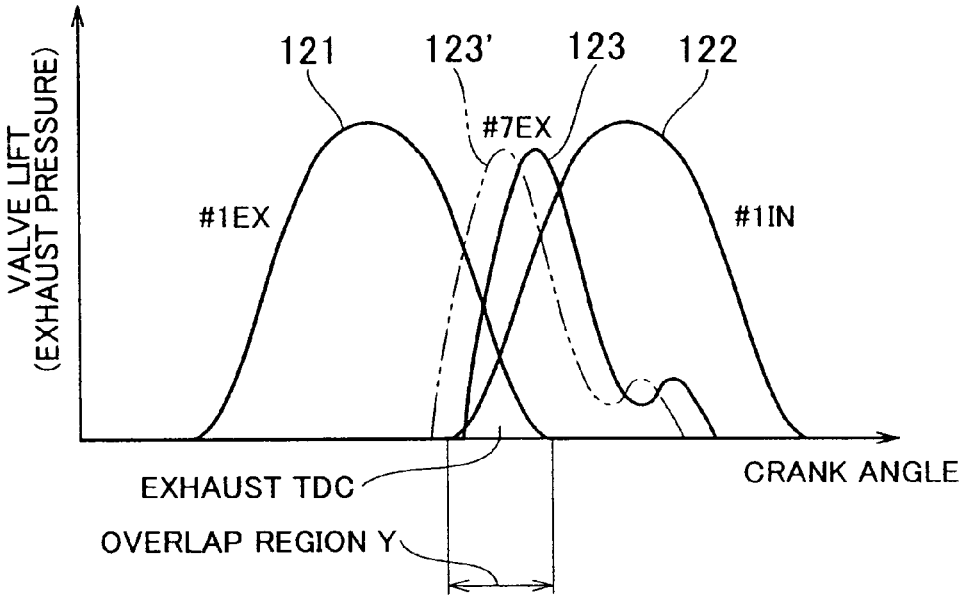
FIG. 7 is a graph illustrating a relationship between the lift amount of the valves in the #1 cylinder 91 and the crank angle.

FIG. 7 is a graph illustrating a relationship between the lift amount of the valves in the #1 cylinder 91 and the crank angle. In this graph, "0" position of the ordinate represents a closed state of each valve, and the lift amount (i.e., valve opening) of each valve increases towards the upper side of the graph. Curve 121 represents the lift amount of the exhaust valves 32 in the #1 cylinder 91, and curve 122 represents the lift amount of the intake valves 22 in the #1 cylinder 91. The portion at which the areas defined by curve 121 and curve 122 overlap each other corresponds to an overlap region Y for the #1 cylinder 91, and the valve overlap region Y extends across the exhaust TDC (Top Dead Center) of the #1 cylinder 91.

Curve 123 represents the pressure of exhaust gas discharged from the exhaust valves 32 of the #7 cylinder 97. Curve 123' represents the same pressure when the cam 57 for driving the exhaust valves 32 of the #7 cylinder 97 is provided at the position 57'. In the case of curve 123', the timing the pressure of exhaust gas from the #7 cylinder 97 peaks substantially coincides with the exhaust TDC of the #1 cylinder 91. In the case of curve 123, on the other hand, the opening timing of the exhaust valves 32 of the #7 cylinder 97 is delayed due to the foregoing cam arrangement on the exhaust cam shaft 31, so curve 123 lies in the right side of curve 123'.

Thus, the timing the pressure of exhaust gas from the #7 cylinder 97 peaks and the center of the valve overlap region Y come to different points. As a result, the pressure of exhaust gas that is discharged from the #7 cylinder 97 while the #1 cylinder 91 is going through the valve overlap region Y decreases, weakening a pressure pulse which travels from the #7 cylinder 97 to the #1 cylinder 91 via the exhaust manifold 102. Moreover, the amount of exhaust gas that reverses from the #7 cylinder 97 to the #1 cylinder 91 reduces which lowers the intake temperature in the #1 cylinder 91 and reduces the amount of residual gas therein. As a result, air intake to the #1 cylinder 91 is made smooth and the volumetric efficiency of the #1 cylinder 91 improves.

Figure 8:
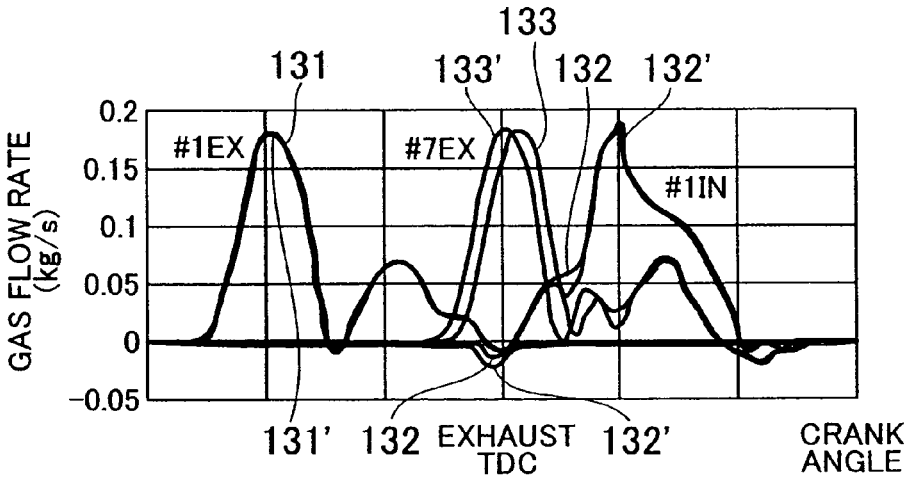
FIG. 8 is a graph illustrating a relationship between the gas flow rate of the #1 and #7 cylinders and the crank angle, which has been obtained through simulation.

FIG. 8 is a graph illustrating a relationship between the gas flow rate of the cylinders #1 and #7 and the crank angle, which has been obtained by simulation. In FIG. 8, curve 131 represents the exhaust gas flow rate at the #1 cylinder 91 and curve 132 represents the intake gas flow rate at the #1 cylinder 91. Curve 133 represents the exhaust gas flow rate at the #7 cylinder 97. Curve 131', 132', and 133' represent the exhaust gas flow rate and the intake gas flow rate at the #1 cylinder 91 and the exhaust gas flow rate at the #7 cylinder 97, respectively, when the cam 57 for driving the exhaust valves 32 of the #7 cylinder 97 is provided at the position 57' in FIG. 5. A comparison between curve 132 and curve 132' makes it clear that arranging the exhaust cam 57 at the 90+α° position reduces the amount of gas that reverses to the intake side of the #1 cylinder 91 around the exhaust TDC of the #1 cylinder 91.

This relationship also applies to each combination of the #3 cylinder 93 and the #5 cylinder 95, the #2 cylinder 92 and the #8 cylinder 98, and the #6 cylinder 96 and the #4 cylinder 94.

According to the first exemplary embodiment, it is possible to suppress exhaust gas interference among the cylinders in the same bank and thus improve their volumetric efficiency by simply shifting the phase position of a specific cam(s) in the retard direction. Therefore, the production cost of the cam shaft is smaller than that for a cam shaft having cams with different profiles to obtain the same effects as mentioned above. Also, even if an assembled type cam shaft is used, cams having a common profile can be used and this eliminates the possibility of misalignment of the cams during assembly of the cam shaft.

Second Exemplary Embodiment

Figure 9:
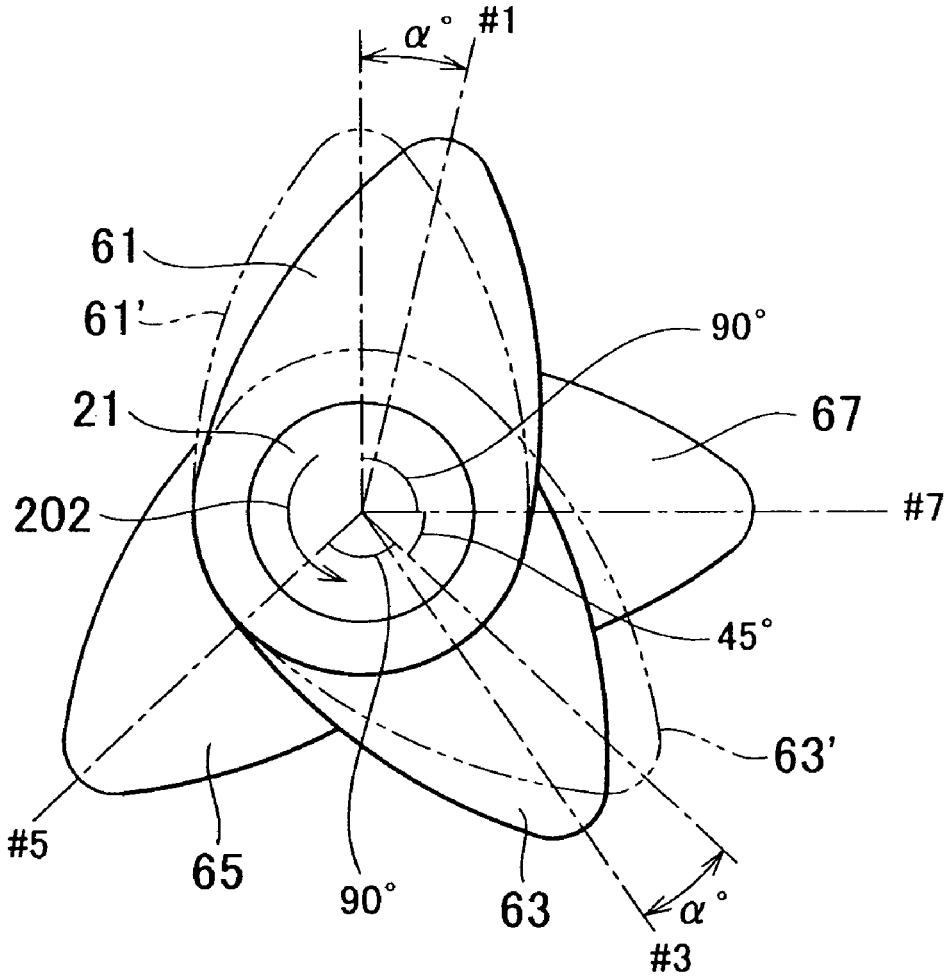
FIG. 9 shows a front view of an intake cam shaft as seen along arrow IX in FIG. 1.

FIG. 9 shows a front view of the intake cam shaft 21 of the engine 10 according to the second exemplary embodiment as seen along arrow IX in FIG. 1. Note that the scissors gear 89 is not shown in FIG. 9. In this embodiment, the engine 10 incorporates the following cam arrangement for the intake cam shaft 21, instead of the foregoing cam arrangement of the exhaust cam shaft 31 in which the phase positions of specific exhaust cams are shifted in the retard direction. Note that descriptions will not be repeated for the structures, functions, and so on, which have already been described in the first exemplary embodiment.

As shown in FIG. 9, cams are formed on the intake cam shaft 21 along its axial direction, which are a cam 61 for driving the intake valves 22 of the #1 cylinder 91, a cam 63 for driving the intake valves 22 of the #3 cylinder 93, a cam 65 for driving the intake valves 22 of the #5 cylinder 95, and a cam 67 for driving the intake valves 22 of the #7 cylinder 97. Like the foregoing exhaust cams, each of the cams 61, 63, 65, 67 has a cross sectional shape which extends in one side along the radial direction of the intake cam shaft 21, forming a nose. As the exhaust cam shaft 31 rotates, the nose of each cam depresses a valve lifter provided at a corresponding intake valve 22 and thereby opens it. Thus, the cams 61, 63, 65, and 67 have the same profile.

The intake cam shaft 21 rotates counterclockwise, i.e., in the direction pointed by allow 202 in FIG. 9 and turns once every time the crank shaft 83 turns twice, i.e., per 720° C.A. The cylinder firing interval between the #5 cylinder 95 and the #7 cylinder 97 is 270° C.A, therefore the nose of the cam 65 is located 135° (=270° C.A/2) away from the nose of the cam 67 in the retard direction (i.e., the direction reverse to the rotating direction of the intake cam shaft 21 pointed by allow 202).

Meanwhile, the cam 61 for driving the intake valves 22 of the #1 cylinder 91 which is fired 180° C.A ahead the #7 cylinder 97 is formed such that the nose of the cam 61 is located 90°−α° away from the nose of the cam 67 in an advance direction, i.e., the direction pointed by arrow 202 (the position 61' in FIG. 9). That is, the position of the nose of the cam 61 is shifted α° back in the retard direction from the position that is 90° away in the advance direction from the nose of the cam 67. Similarly, the cam 63 for driving the intake valves 22 of the #3 cylinder 93 which is fired 180° C.A ahead the #5 cylinder 95 is formed such that the nose of the cam 63 is located 90°−α° away from the nose 65 in the advance direction. That is, the position of the nose of the cam 63 is shifted α° back in the retard direction from the position that is 90° away in the advance direction from the nose 65 (the position 63' in FIG. 9). For example, α° is set to 10°, however it may be set to other angle based on the profile of each cam, the required engine performance/characteristic, and so on.

The intake cam shaft 26 also has substantially the same construction as that of the intake cam shaft 21 described above. That is, the cam for driving the intake valves 22 of the #6 cylinder 96 is formed such that its nose is located 90°−α° away in the advance direction from the nose of the cam for driving the intake valves 22 of the #4 cylinder 94. Likewise, the cam for driving the intake valves 22 of the #2 cylinder 92 is formed such that its nose is located 90°−α° away in the advance direction from the nose of the cam for driving the intake valves 22 of the #8 cylinder 98.

Figure 10:
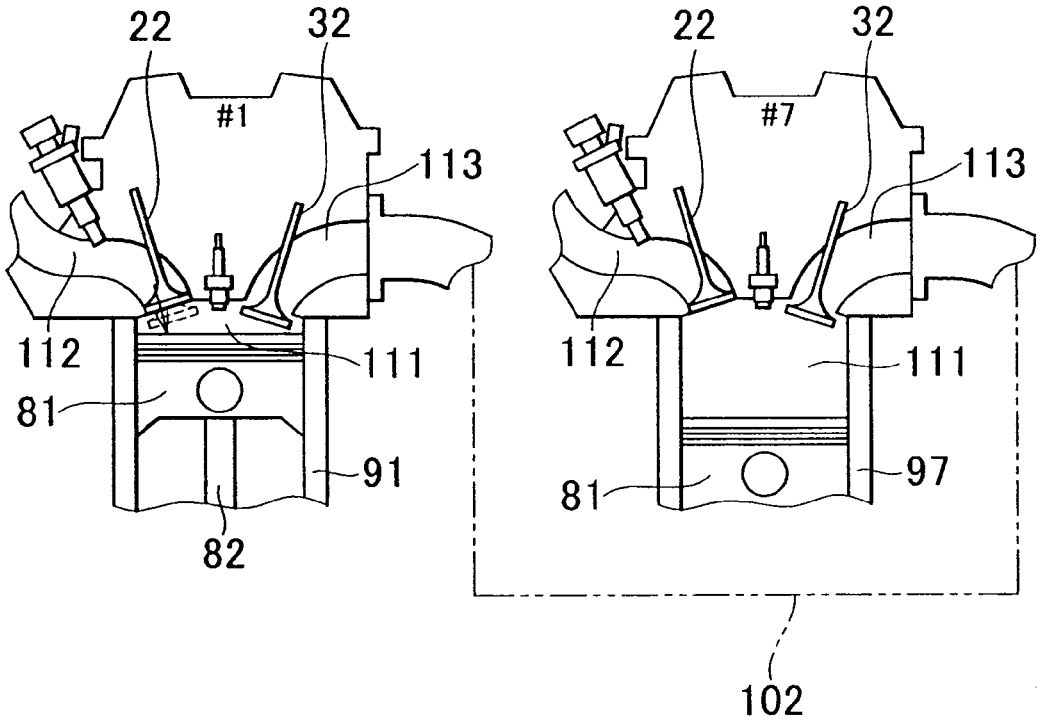
FIG. 10 shows cross sectional views of the #1 and #7 cylinders.

FIG. 10 shows cross sectional views of the #1 cylinder 91 and the #7 cylinder 97, respectively, which correspond to those in FIG. 6 for the first exemplary embodiment. As described above, according to the second exemplary embodiment, for example, the position of the nose of the cam 61 is shifted in the retard direction by α° from the position that is away in the retard direction from the nose of the cam 51 by an angle corresponding to the cylinder firing interval between the #1 cylinder 91 and the #7 cylinder 97 (=180° C.A=90°). Therefore, the timing at which the intake valves 22 start opening in the #1 cylinder 91 during its shift from an exhaust stroke to an intake stroke is delayed with respect to the time period during which the exhaust valves 32 are open in the #7 cylinder 97.

Figure 11:
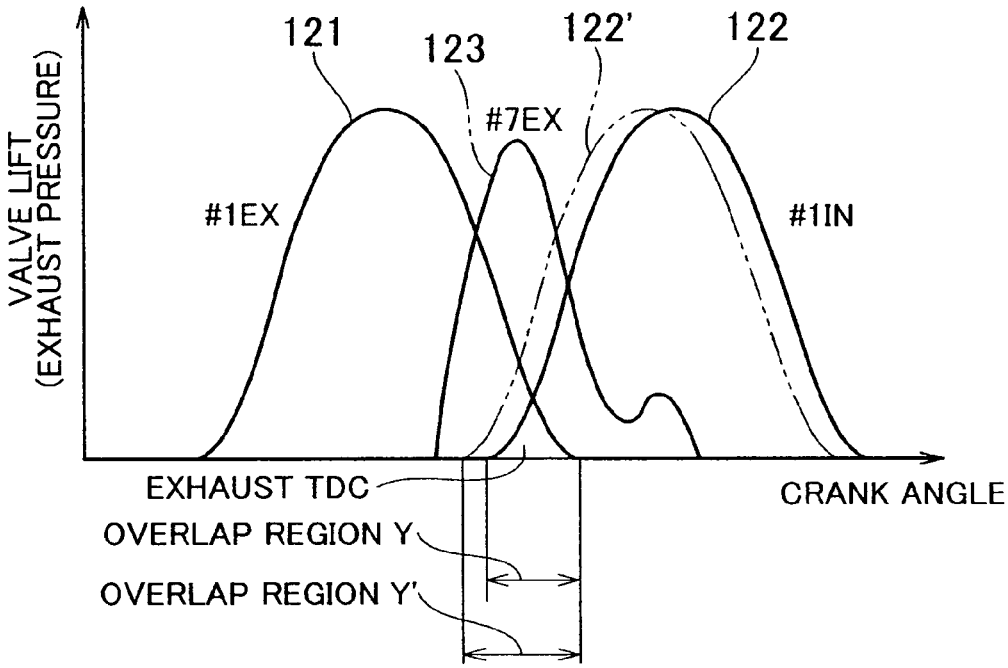
FIG. 11 is a graph illustrating a relationship between the lift amount of the valves in the #1 cylinder and the crank angle under a condition illustrated by FIG. 10.

FIG. 11 is a graph illustrating the relationship between the lift amount of the valves in the #1 cylinder 91 and the crank angle, and this graph corresponds to the graph of FIG. 7 for the first exemplary embodiment. The curves identified by the same numbers as those in FIG. 7 shall be regarded equal to the corresponding curves in FIG. 7. In FIG. 11, curve 122' represents the valve lift of the intake valves 22 in the #1 cylinder 91 obtained when the cam 21 is provided at the position denoted by 61' in FIG. 9, and the portion at which the areas defined by curve 121 and curve 122' overlap each other corresponds to a valve overlap region Y'. On the other hand, curve 122 represents the same valve lift obtained when the cam 21 is located at the position shifted in the retard direction by α° from the position 61'. In this case, the timing of opening the intake valves 22 of the #1 cylinder 91 is delayed, so curve 122 lies in the right side of curve 122' accordingly. The portion at which the areas defined by curve 121 and curve 122 overlap each other corresponds to a valve overlap region Y.

Referring to FIG. 11, the valve overlap region Y is narrower than the valve overlap region Y°, and the overlap between the valve overlap region Y and the time period during which the exhaust pressure of the #7 cylinder 97 is high becomes smaller. As a result, the influence of exhaust gas discharged from the #7 cylinder 97 on the air intake of the #1 cylinder 91 diminishes, so the volumetric efficiency of the #1 cylinder 91 improves accordingly.

In addition, the cam 61 may be formed into a profile that provides an earlier intake valve opening timing and a smaller intake valve operation angle than those obtained with the profile of the cam 67. Although it is true that different profiles are used in this case, it is possible to further delay the opening timing of the intake valve 22 and improve the volumetric efficiency of the #1 cylinder 91.

This relationship also applies to each combination of the #3 cylinder 93 and the #5 cylinder 95, the #2 cylinder 92 and the #8 cylinder 98, and the #6 cylinder 96 and the #4 cylinder 94.

Accordingly, the engine 10 of the second exemplary embodiment provides the same advantages and effects as described in the first exemplary embodiment.

Third Exemplary Embodiment

According to the third exemplary embodiment, the engine 10 is provided with the exhaust cam shaft 31 of the first exemplary embodiment and the intake cam shaft 21 of the second exemplary embodiment. However, in this embodiment, the value of α° by which specific cams of the intake and exhaust shafts are shifted in the retard direction is set to 5°, for example.

Figure 12:
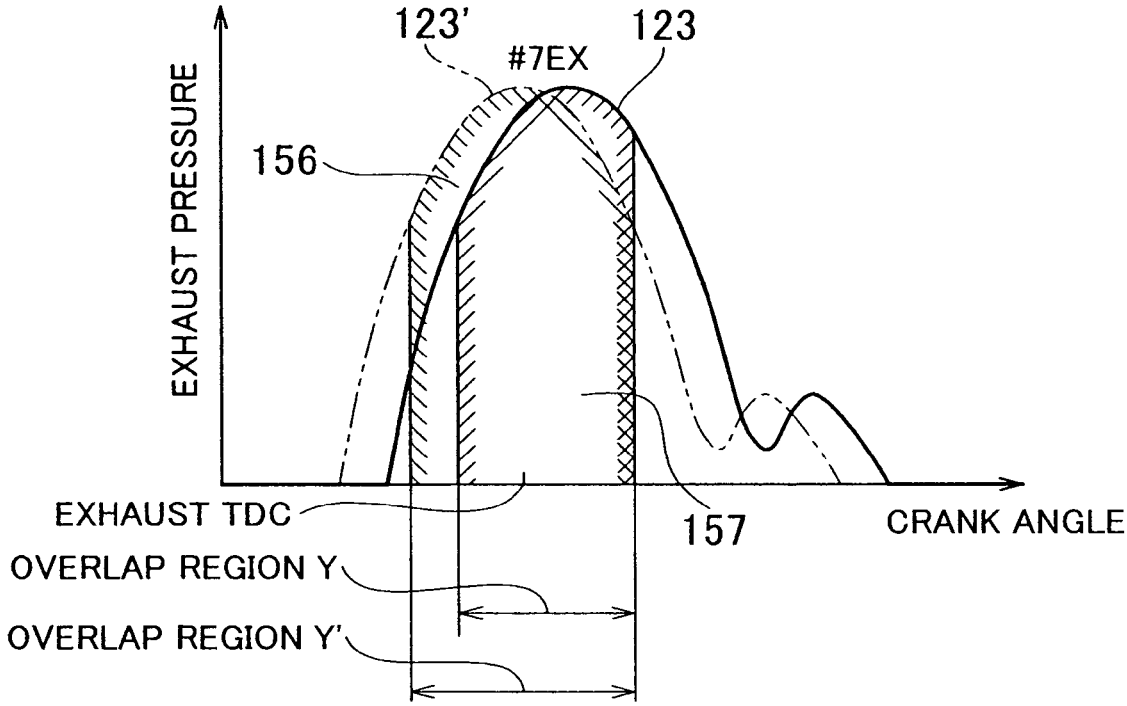
FIG. 12 is a graph illustrating a relationship between the pressure of exhaust gas from the #7 cylinder and the crank angle.

FIG. 12 is a graph illustrating the relationship between the pressure of exhaust gas from the #7 cylinder 97 and the crank angle. Curve 123 represents the pressure of exhaust gas from the #7 cylinder 97, and curve 123' represents the same pressure when the cam 57 for driving the exhaust valves 32 in the #7 cylinder 97 is provided at the position 57' in FIG. 5. The valve overlap region Y represents a valve overlap region of the #1 cylinder 91 during which the intake and exhaust valves are both open in the #1 cylinder 91, and the valve overlap region Y' represents the same valve overlap region when the cam 61 for driving the intake valves 22 in the #1 cylinder 91 is provided at the position denoted by 61' in FIG. 9.

As evident from FIG. 12, providing the cam 53 at the shifted position on the exhaust cam shaft 31 displaces the timing the exhaust gas pressure peaks relative to the valve overlap region Y' and providing the cam 61 at the shifted position on the intake cam shaft 21 narrows down the valve overlap region (valve overlap region Y' →valve overlap region Y). Therefore, it is possible to reduce the influence of exhaust gas discharged from the #7 cylinder 97 on the air intake of the #9 by an amount corresponding to the area 156 in FIG. 12.

Accordingly, the engine 10 of the second exemplary embodiment provides the same advantages and effects as those described in the first exemplary embodiment.

While the foregoing three exemplary embodiments have been constructed as a V-eight cylinder internal combustion engine, the invention may be applied to other multi-cylinder engines such as in-line four cylinder engines including an exhaust manifold having pipes with different length for the respective cylinders. Also, the invention may be applied to diesel engines as well as gasoline engines. Further, the invention may be applied to multi-cylinder engines including electromagnetically driven valves or hydraulically driven valves.

While the invention has been described with reference to exemplary embodiments thereof, it is to be understood that the invention is not limited to the exemplary embodiments or constructions. To the contrary, the invention is intended to cover various modifications and equivalent arrangements other than described above. In addition, while the various elements of the exemplary embodiments are shown in various combinations and configurations, which are exemplary, other combinations and configurations, including more, less or only a single element, are also within the spirit and scope of the invention.

What is claimed is:

1. A multi-cylinder internal combustion engine, comprising:

a first cylinder;

a second cylinder that shares an exhaust manifold with the first cylinder and is fired a predetermined firing interval after the first cylinder; and an exhaust cam shaft having a first cam for opening/closing an exhaust valve of the first cylinder and a second cam for opening/closing an exhaust valve of the second cylinder, wherein a valve overlap region of the first cylinder while the first cylinder is shifting from an exhaust stroke to an intake stroke overlaps a time period during which the exhaust valve of the second cylinder is open while the second cylinder is shifting from a power stroke to an exhaust stroke; and a nose of the first cam is located at a first phase position and a nose of the second cam is located at a second phase position on the exhaust cam shaft, the second phase position being farther in a retard direction than a position that is away in the retard direction from the first phase position by an angle corresponding to the predetermined firing interval.

2. The multi-cylinder engine according to claim 1, further comprising:

an intake cam shaft having a third cam for opening/closing an intake valve of the first cylinder and a fourth cam for opening/closing an intake valve of the second cylinder, wherein a nose of the third cam is located at a third phase position and a nose of the fourth cam is located at a fourth phase position on the intake cam shaft, the third phase position being farther in a retard direction than a position that is away in an advance direction from the fourth phase position by an angle corresponding to the predetermined firing interval between the first and second cylinders.

3. The multi-cylinder engine according to claim 1, further comprising:

an intake cam shaft having a third cam for opening/closing an intake valve of the first cylinder and a fourth cam for opening/closing an intake valve of the second cylinder, wherein the third cam has a profile that provides a delayed intake valve opening timing and a smaller intake valve operation angle as compared to an intake valve opening timing and an intake valve operation angle obtained with a profile of the fourth cam.

4. The multi-cylinder engine according to claim 2, wherein the third cam has a profile that provides a delayed intake valve opening timing and a smaller intake valve operation angle as compared to an intake valve opening timing and an intake valve operation angle obtained with a profile of the fourth cam.

5. A multi-cylinder internal combustion engine, comprising:

a first cylinder;

a second cylinder that shares an exhaust manifold with the first cylinder and is fired a predetermined firing interval after the first cylinder; and an intake cam shaft having a third cam for opening/closing an intake valve of the first cylinder and a fourth cam for opening/closing an intake valve of the second cylinder, wherein a valve overlap region of the first cylinder while the first cylinder is shifting from an exhaust stroke to an intake stroke overlaps a time period during which an exhaust valve of the second cylinder is open while the second cylinder is shifting from a power stroke to an exhaust stroke; and a nose of the third cam is located at a third phase position and a nose of the fourth cam is located at a fourth phase position on the intake cam shaft, the third phase position being farther in a retard direction than a position that is away in an advance direction from the fourth phase position by an angle corresponding to the predetermined firing interval between the first and second cylinders.

6. A multi-cylinder internal combustion engine according to claim 5 wherein the third cam has a profile that provides a delayed intake valve opening timing and a smaller intake valve operation angle as compared to an intake valve opening timing and an intake valve operation angle obtained with a profile of the fourth cam.

* * * * *

UNITED STATES PATENT AND TRADEMARK OFFICE

CERTIFICATE OF CORRECTION

PATENT NO. : 7,204,214 B2
APPLICATION NO. : 11/236632
DATED : April 17, 2007
INVENTOR(S) : Yoshihiro Miyaji et al.

It is certified that error appears in the above-identified patent and that said Letters Patent is hereby corrected as shown below:

| Column | Line | |
|---|---|---|
| 1 | 42 | After “angle” insert --of--. |
| 5 | 17 | Change “#**92**” to --**92**--. |
| 5 | 18 | Change “cylinder **6**” to --cylinder **96**--. |
| 5 | 29 | Change “#**92**” to --**92**--. |
| 5 | 30 | Change “cylinder **6**” to --cylinder **96**--. |
| 6 | 13 | Change “allow **201**” to --arrow **201**--. |
| 6 | 20 | Change “allow **201**” to --arrow **201**--. |
| 6 | 36 | Change “angle” to --angles--. |
| 7 | 23 | After “timing” insert --of--. |
| 8 | 27 | Change “allow **202**” to --arrow **202**--. |
| 8 | 34 | Change “allow **202**” to --arrow **202**--. |
| 8 | 51 | Change “angle” to --angles--. |
| 9 | 32 | Change “Y°” to --Y’--. |

UNITED STATES PATENT AND TRADEMARK OFFICE

CERTIFICATE OF CORRECTION

PATENT NO. : 7,204,214 B2
APPLICATION NO. : 11/236632
DATED : April 17, 2007
INVENTOR(S) : Yoshihiro Miyaji et al.

It is certified that error appears in the above-identified patent and that said Letters Patent is hereby corrected as shown below:

| Column | Line | |
|---|---|---|
| 10 | 10 | After "timing" insert --of--. |
| 10 | 16 | Change "#9" to --#1 cylinder **91**--. |

Signed and Sealed this

Twenty-fifth Day of March, 2008

JON W. DUDAS
*Director of the United States Patent and Trademark Office*